US005515897A

United States Patent [19]

Fehan

[11] Patent Number: 5,515,897

[45] Date of Patent: May 14, 1996

[54] GOLF BAG TRAVEL COVER

[75] Inventor: Douglas R. Fehan, 833 Hazel, Birmingham, Mich. 48009

[73] Assignee: Douglas Fehan, Birmingham, Mich.

[21] Appl. No.: 78,996

[22] Filed: Jun. 17, 1993

[51] Int. Cl.[6] ..... B65D 65/08

[52] U.S. Cl. ..... 150/159; 206/315.4

[58] Field of Search ..... 190/154, 159; 206/315.4, 315.3, 315.8; 280/47.26, DIG. 6

[56] References Cited

U.S. PATENT DOCUMENTS

| | | | |
|---|---|---|---|
| D. 312,531 | 12/1990 | Sherer et al. . | |
| D. 319,346 | 8/1991 | Jessen . | |
| 1,249,439 | 12/1917 | McCoy | 224/42.32 |
| 1,282,797 | 10/1918 | Fouts | 220/623 |
| 1,617,115 | 2/1927 | Hotze | 206/315.4 |
| 1,902,644 | 3/1933 | Hotze | 206/315.8 |
| 2,094,186 | 9/1937 | Patrick . | |
| 2,175,071 | 10/1939 | Walker | 220/671 |
| 2,527,085 | 10/1950 | Snow | 220/623 |
| 2,552,501 | 5/1951 | Wilkens . | |
| 2,599,790 | 6/1952 | Stuart | 220/623 |
| 2,704,563 | 3/1955 | Henrich . | |
| 2,718,251 | 9/1955 | Barbato . | |
| 2,868,559 | 1/1959 | Vincelette | 280/DIG. 6 |
| 3,059,681 | 10/1962 | Lorbeski | 206/315.4 X |
| 3,316,951 | 5/1967 | Jacobson | 206/315.4 X |
| 3,331,420 | 7/1967 | Wilkens | 206/315.8 |
| 3,675,698 | 7/1972 | LeGoff | 206/315.8 |
| 3,901,299 | 8/1975 | Picco . | |
| 4,012,051 | 3/1977 | Embinder | 280/DIG. 6 |
| 4,091,977 | 5/1978 | Luttbeg | 206/315.4 |
| 4,563,034 | 1/1986 | Lamb | 296/98 |
| 4,657,135 | 4/1987 | Kjose . | |
| 4,911,292 | 3/1990 | Airey, Jr. . | |
| 4,961,497 | 10/1990 | Sherer et al. . | |
| 5,029,703 | 7/1991 | Dulyea, Sr. | 206/315.3 |
| 5,029,883 | 7/1991 | Perito | 280/47.26 X |
| 5,044,476 | 9/1991 | Seynhaeve . | |
| 5,072,867 | 12/1991 | Zingale . | |
| 5,112,068 | 5/1992 | Liao et al. | 280/DIG. 6 |
| 5,143,389 | 9/1992 | Jonkers | 280/47.26 |
| 5,220,950 | 6/1993 | Cordasco | 206/315.4 X |
| 5,265,894 | 11/1993 | Dunn | 206/315.4 X |

*Primary Examiner*—Allan N. Shoap
*Assistant Examiner*—Christopher J. McDonald
*Attorney, Agent, or Firm*—Dinnin & Dunn

[57] ABSTRACT

A golf bag travel cover for use in transporting a golf bag. The golf bag travel cover includes a base member which is connected to a flexible cover and an interior ring. The golf bag travel cover also includes a strap which connects directly to the golf bag instead of the golf bag travel cover. The golf bag travel cover also has a pair of wheels which are located on the outer portion of the base member for use in pulling the golf bag travel cover hands-free with just a shoulder strap. The golf bag travel cover combines the durability and protection of a high density plastic golf bag cover with the lightweight and convenience of a nylon type cover to create the ultimate in a travel golf bag design.

24 Claims, 2 Drawing Sheets

GOLF BAG TRAVEL COVER

BACKGROUND OF THE INVENTION

1. Field of the Invention

The present invention relates generally to a golf bag and more particularly, to a golf bag travel cover.

2. Description of the Related Art

Golf clubs are typically carried or transported in a traditional golf bag which is approximately the length of the clubs so that the golf club heads may extend out of the bag. This allows the golfer to easily identify the club desired and easily grasp the club to remove it from the bag. The golf bag also contains a plurality of pouches to carry other golf accessories such as golf balls, tees, gloves, shoes, umbrellas, outer wear, and a myriad of golf "gadgets" available. Golf bags are typically made of leather, canvas or a type of nylon or nylon composite such as Cordura™ from Dupont. Golf bags also come in a variety of styles and sizes. Golfers make a substantial investment in their golf clubs, golf bag, golf shoes and golf accessories and generally do not wish these items to be damaged.

A major source of damage to golf bags and clubs is travel, particularly on airlines. Golfers frequently like to bring their golf clubs when traveling on vacation or traveling where they will have an opportunity to play golf. When stored as luggage on commercial transportation, the golf bags are often thrown around or have other luggage thrown onto them or otherwise mistreated. This can result in bent hosels or shafts on the golf clubs and scratches or tears in the golf bag. Thus, most golfers use some type of travel cover for transporting their golf clubs.

One cover, the simplest, is generally sold with the golf bag, and comprises a soft sided cover the same material as the bag. This cover attaches at the top of the bag and merely covers the club heads, not the bag itself. This cover is useful to contain the clubs in the bag and restricts the rattling of the clubs, and is often used as a cover for the clubs when playing golf in the rain (many golfers are very serious about golf). Typically this cover is used in conjunction with a full travel cover to more fully protect the golf clubs.

Other types of transportation covers for golf clubs have been tried and generally fall into two groups, hard sided travel covers and soft sided travel covers. The hard sided travel cover is typically made from a hard plastic and provides superior protection from impact. A hard sided travel cover is also more stable and can be stood upright to load the golf bag. However, hard sided travel covers have numerous disadvantages, most obviously that they are extremely bulky because they must be large enough to fit a variety of sizes of golf bags. In most instances a hard sided travel cover will completely fill an average size automobile trunk. For similar reasons, a hard sided travel cover also is very difficult to store. Golf bags also may shift within a hard sided cover, causing rattling and potential damage to the golf club heads. The hard sided travel cover is also difficult to carry up or down stairs because of the weight and bulkiness of the cover or shell. The hard sided travel cover also is awkward to maneuver while in line at ticket counters in airports or rental car agencies. Because of the weight of the material and the size of the cover, the hard sided travel cover also is very heavy and difficult to lift or move. A hard sided cover also is expensive, which deters the golfer on a budget.

An advantage of the soft sided travel cover is that it is lightweight and easy to move or lift. Since a soft-sided cover conforms to the golf bag it takes up relatively little space.

Another advantage of the soft sided travel cover is that it is easy to load and relatively inexpensive. However, the soft sided travel cover also has disadvantages, including that it does not protect the golf cover and golf clubs from hard blows as well as a hard sided cover. The soft sided travel cover also does not stand upright but tends to fall to one side or another. The soft sided travel cover also does not have the capability of being wheeled up stairs with its own wheels. The soft sided travel cover can also be ripped or caught on edges or surfaces which may expose the golf bag and golf clubs to damage.

Many travel covers for golf clubs have straps or handles on the exterior of the travel cover which allow the golf bag inside of the cover to shift and move around continuously. Continuous movement of the golf bag within the travel cover will damage the clubs harming the shafts, heads and even the grips. The usual golf bag tends to be very heavy on the bottom to allow it to stand, but the height and weight distribution of clubs make it easy to tip. Therefore, it is desirable to have a golf bag travel cover which is easier to handle, not as bulky or heavy, and has a better balance point so that it will not tip when loading the golfer's golf bag into the cover.

The typical golf bag travel cover can only be carried by hand or with the golf bag or similar shoulder strap, reducing the amount of luggage that can be carried along with the golf bag. While such bags or covers may be carried about the shoulder, the position of the bag restricts the availability of the hands to carry additional luggage. Therefore it is also desirable to have a golf bag travel cover which can be used with wheels thus allowing it to roll along while keeping the golfer's hands free. This rolling golf bag travel cover also should be able to be pulled up stairs without exerting undue amounts of energy. Older bags were often bulky and difficult to carry up the stairs or down the stairs thus creating additional problems for the traveler. It is preferred that the wheels to be used on such travel cover would allow steering so that the travel cover will respond to any direction pulled. It is also desirable for a golf bag travel cover to only require an extended shoulder strap to allow the golfer to carry other luggage with his hands while pulling the travel cover and golf bag.

SUMMARY OF THE INVENTION

One object of this invention, is to provide a golf bag travel cover.

Another object of the present invention is to provide a golf bag travel cover which uses wheels and has rolling stability.

It is also an object of the present invention to provide a relatively lightweight golf bag travel cover which is soft sided and will conform to the golf bag, minimizing storage space while traveling.

Another object of the present invention is to provide a golf bag travel cover which has a rigid base member to allow the cover to stand alone, to allow the traveler to insert a golf bag in a vertical position and then zip the cover over the top of the golf bag.

Another object of the present invention is to provide a golf bag travel cover which includes a locator ring. This locator ring will properly and quickly locate and hold a broad array of today's golf bag designs.

It is yet another object of the present invention to provide a golf bag travel cover which is easier to pull up stairs. The stair climbing capability will allow the golfer to slide the travel cover up the front riser of each stair until the wheels make contact and allow the golf bag travel cover to be rolled up onto the next step.

It is still another object of the present invention to provide a golf bag travel cover which permits hands-free operation allowing the golfer to carry additional luggage and/or a briefcase.

A further object of the invention is to provide a single point attachment directly to the golf bag to reduce potential shifting of the golf bag within the travel cover and to provide greater stability to the golf bag travel cover while rolling.

Another object is to provide a rigid surface at the top of the travel cover to shield club heads from impact forces.

To achieve the foregoing objects, the present invention is a golf bag travel cover. The golf bag travel cover includes a base member, a flexible cover, an interior ring, a shoulder strap, and a pair of wheels for use in pulling the golf bag travel cover. The base member is connected to the flexible cover and the interior ring via a connecting mechanism. The golf bag travel cover's wheels do not touch the ground when it is placed in the upright position. The wheels will touch the ground when the shoulder strap is placed around the shoulder and the golf bag travel cover is tilted forward.

Other objects, features and advantages of the present invention will be readily appreciated as the same becomes better understood after reading the following description taken in conjunction with the accompanying drawings.

DESCRIPTION OF THE PREFERRED EMBODIMENTS

Figure 1:
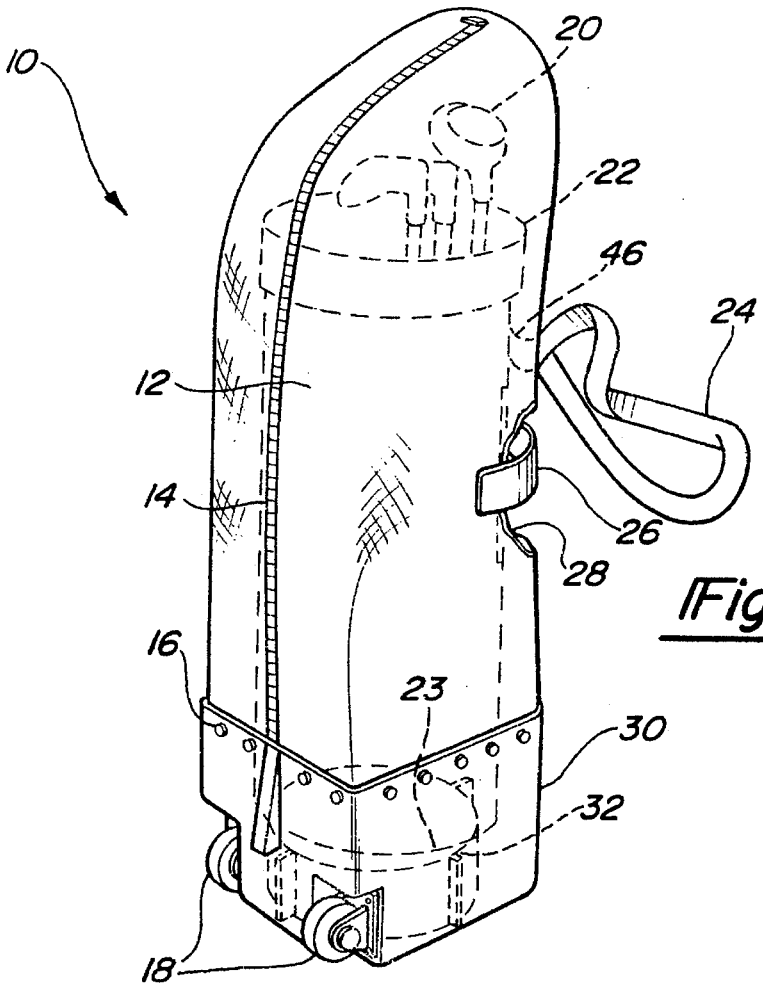
FIG. 1 is a full frontal view of a golf bag travel cover according to the present invention.

A golf bag travel cover 10 according to the present invention is illustrated in FIG. 1. The golf bag travel cover 10 is designed to provide a secure place for golf bags and clubs during transportation. The golf bag travel cover 10 includes a base member 30, a flexible cover 12, a shoulder strap 24, an interior ring 40, and a pair of wheels 18. These elements form a light weight yet durable travel cover for a golf bag. The components which make up the golf bag travel cover 10 all are serviceable and thus replaceable.

The base member 30 allows the golf bag travel cover 10 to stand upright without tipping over. The base member 30 may be formed from an ABS injection molded substance or high density polyethylene (HDPE). This material gives the base member 30 the requisite hardness and rigidity. The base member 30 generally has the appearance of a square bucket. The base member 30 is made at a predetermined height which will allow the golf bag travel cover 10 to be easily pulled up stairs. In the preferred embodiment the predetermined height is approximately 9", which is two inches greater than the typical maximum rise of a step in a flight of stairs. The base member 30 also has a slight draft in its outer wall which gives an outward angle of approximately ⅛" over the 9" height of the base member 30. This slight draft will also facilitate pulling the base member 30 up stairs. The base member 30 is also manufactured with a plurality of holes 38 on its top edge in order to secure the base member 30 to the flexible cover 12 and the interior ring 40.

Figure 5:
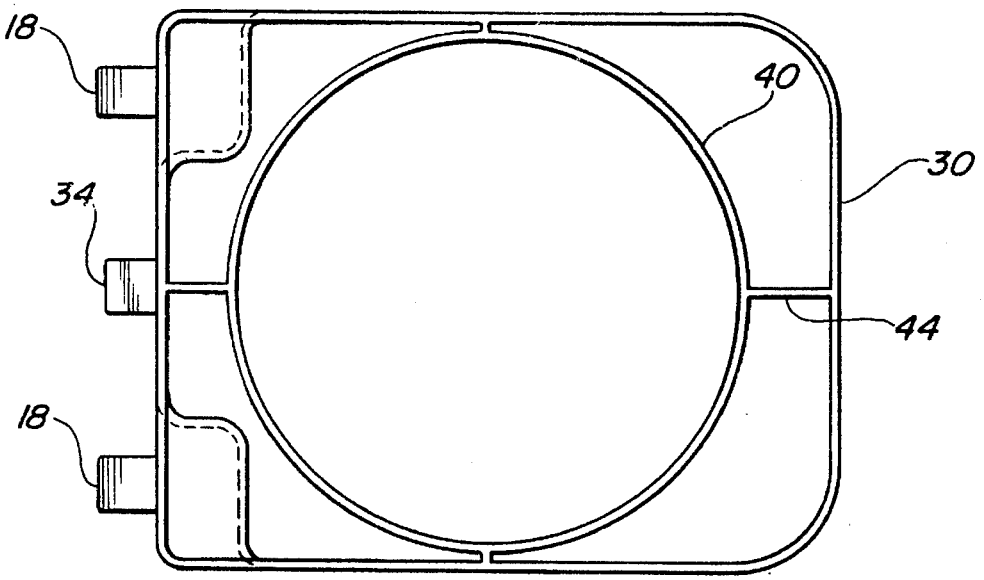
FIG. 5 is a top view of the base member.

The base member 30 also includes a locator ring 32 located on the inside bottom face of the base member 30, see FIG. 5. The locator ring 32 is used to securely hold the base 23 of the golf bag 22 in place within the base member 30. Nearly all golf bags have a circular base 23, from which a variety of bag configurations will rise. The circumference of the base 23 will vary according to the size of the bag 22, but the variation is not as great as the variation in overall sizes of the bags. Therefore, the locator ring 32 is large enough to accommodate the base 23 of even the largest bags but the overall travel cover will not be appreciably larger than a small bag contained within. The locator ring 32 keeps the golf club bag 22 from shifting or moving during transportation thus reducing the damage to the clubs 20 and/or the bag 22. The locator ring 32 extends inwardly from the bottom inside face of the base member 30 this will allow the base to be wider for further stability.

Figure 4:
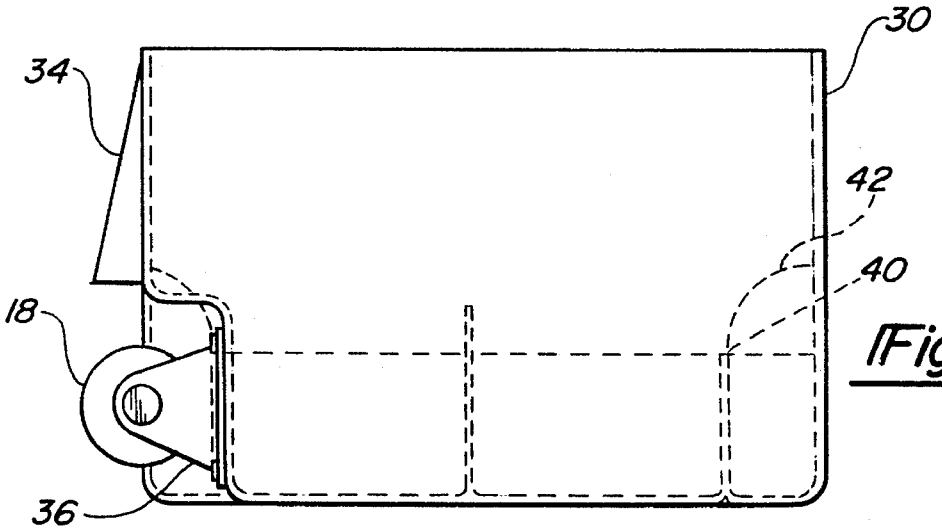
FIG. 4 is a side view of the base member and inside components.

The interior of the base member 30 also includes a plurality of ribs 42 which may be either curved or straight, as seen in FIG. 4. These ribs 42 are connected between the top of the locator ring 32 and the side of the base member 30. The ribs 42 are used to guide the base 23 of the golf bag 22 into the locator ring 32 which will securely set the golf bag 22 within the golf bag travel cover 10. The ribs 42 also improve the strength of the base member 30 by providing structural support between the outer wall and the inner locator ring 32. The locator ring 32 is a predetermined diameter within the base member 30. The diameter of the locator ring 32 will fit most if not all standard golf bag sizes.

The preferred embodiment also includes a flexible cover 12, preferably of Dupont Cordura™ material. The flexible cover 12 is made of a nylon type material and includes a full length zipper 14. The flexible cover 12 also includes an orifice to permit the shoulder strap 24 to be attached to the golf bag 22 and another orifice 28 about the travel handle of the golf bag 22. The full length zipper 14 runs from the top of the flexible cover 12 down to the top of the base member 30, and can be plastic or any suitable material. The use of the Cordura™ cover or similar waterproof material for the flexible cover 12 gives a strong and durable covering for the golf clubs 20 so that no moisture or any other objects will harm the golf clubs 20.

The total height of the cover is preferably 48" allowing only a 3" play between the top of the longest golf club 20 and the top of the cover 30 but providing enough room to easily insert the golf bag in the cover. The full length plastic zipper 14 makes it extremely easy to load the golf bag 22 into the golf bag travel cover 10. The zipper 14 will open up completely allowing the flexible cover 12 to fall completely around the base member 30 thus allowing easy insertion of the golf bag 22 into the base member 30. The locator ring 32 will securely stand the golf bag 22 upright within the base member 30. The flexible cover 12 is then placed over the top of the golf clubs 20 and closed for easy insertion of the shoulder strap 24.

The top of the flexible cover 12 also may include rigid inserts to protect the club heads from impact. The rigid inserts will be located along the inside surface of the flexible cover 12. The inserts may be made of a plastic material however, any other suitable material may also be used. A padded material known in the art may alternatively or additionally be used in the interior of the top of the flexible cover 12. These inserts will further protect the golf clubs from the wear and tear of commercial travel.

The carrying handle (not shown) at the midpoint of the golf bag 22 is accessible at orifice 28 as another means to carry the golf bag travel cover 10. The shoulder strap 24 attaches directly to the golf bag 22 through the top orifice 46 of the golf bag travel cover 10 so that the bag will not shift while being carried (rolled) and facilitate the pulling of the golf bag travel cover 10 through airports. A flap 26 is connected to the flexible cover 12 which will go through the carrying handle of the actual golf bag 22 and connect via a connecting mechanism, preferably velcro, to securely wrap the flexible cover 12 around the golf bag 22 to prevent rotation of the bag within the cover.

Figure 2:
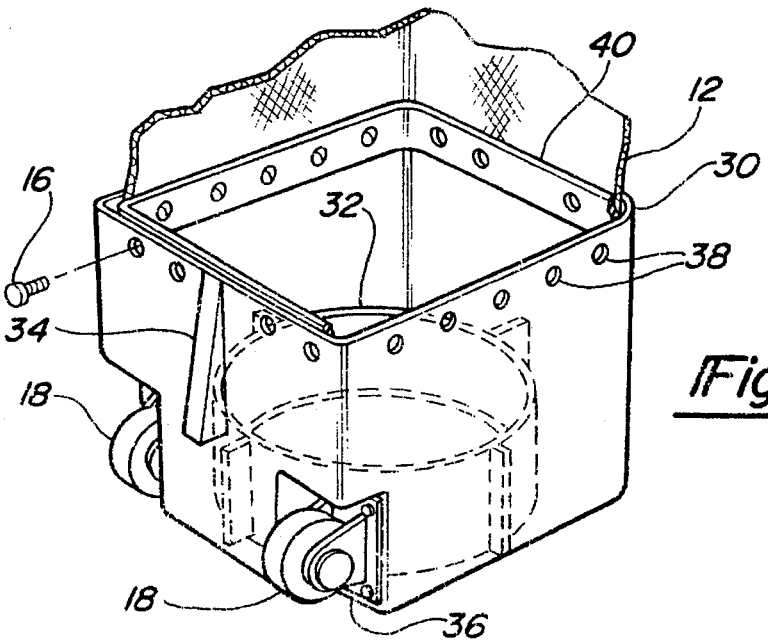
FIG. 2 is a view of the base member of the golf bag travel cover.
Figure 3:
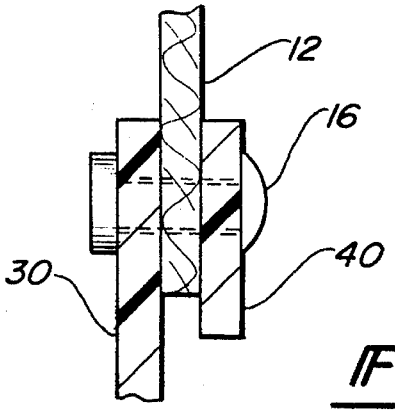
FIG. 3 is a view of how the flexible cover, interior ring and base member are connected.

The flexible cover 12 is connected to the top edge of the base member 30 via an interior ring 40 and a series of machine screws 16, see FIG. 2 and FIG. 3. The flexible cover 12 is placed at the inside of the top edge of the base member 30 and a hole in the flexible cover 12 is aligned with a hole on the base member 30. The interior ring 40 is then placed inside of the flexible cover 12 which is inside of the base member 30 and the holes in the interior ring 40 are lined up with the holes of the flexible cover 12 and the base member 30. A machine screw 16 is then placed through each hole and an acorn nut is used to securely fasten the interior ring 40 to the flexible cover 12 to the base member 30, providing a very secure connection between the flexible cover 12 and the base member 30. Other appropriate attachment methods such as rivets may also be used. The interior ring 40 is made of any suitable metal or composite material. The interior ring 40 strengthens the connection of the base member 30 to the flexible cover 12 to prevent separation and tears at the holes in the flexible cover 12.

The entire golf bag travel cover 10 including the base member 30 and soft sided cordura flexible cover 12 also eliminates the bulky size which was encountered with prior art hard side golf bag covers. The golf bag travel cover 10 will reduce the amount of room necessary to transport in a trunk or store because of the soft Cordura™ flexible cover 12. It also reduces the weight significantly. When the golf bag 22 is removed from the golf bag travel cover 10 the nylon Cordura™ portion of the flexible cover 12 and the shoulder strap 24 are conveniently folded into the base member 30.

The preferred embodiment also includes a pair of wheels 18 which are made of a composite rubber with a high density core. The wheels 18 also include steel bushed industrial casters which allow for squeak free rolling. The wheel assembly also includes a steel yoke 36 which is bolted to the base member 30 and attaches to the wheel 18. The wheel or wheels 18 are located on the side of the base member 30 opposite of the side where the shoulder strap 24 attaches to the golf bag 22. The wheels 18 are located approximately 1 inch from the bottom, so that when the golf bag travel cover 10 is placed in the vertical position, the wheels 18 will not touch the ground. The wheels 18 are also recessed in the side of the base member 30 approximately ½ the diameter of the wheel 18.

The wheel 18 sticking out 1" will cause the wheels 18 to operate when the bag/cover assembly is tilted to approximately a 30° angle from the ground. The wheels 18 are separated as much as possible from one another in order to provide as stable a ride as possible. The wheels are set approximately 8½" apart to allow for smooth pulling and steering and stability of the golf bag travel cover 10.

The wheels 18 were recessed in the base member 30 in order for the golf bag travel cover 10 to be able to be pulled up stairs easily and to shield the wheels from damage during baggage handling. The predetermined height for the base member 30 is chosen such that it is greater than most stair riser heights. This will allow the base member 30 to be pulled along the ground, come into contact with the stairs and slowly rise up until the stair comes in contact with the wheel 18 then the wheel 18 will engage the stair and roll up. This will allow the golf bag travel cover 10 to be pulled up the stairs with little effort. The width of the wheel base ensures that the golf bag travel cover 10 will remain stable up an entire flight of stairs. This will allow a person to have two hands free to carry luggage even going up stairs.

The shoulder strap 24 which allows the hands-free pulling is preferably made of a nylon material but any other material which is known in the art may be used for such shoulder strap 24. The shoulder strap 24 is of an adjustable nature so that it can fit any size or person no matter who is pulling the golf bag travel cover 10. The shoulder strap 24 is connected to the actual golf bag 22 via the orifice in the flexible cover 12. The shoulder strap 24 is connected at one point to the golf bag 22. The usual golf bag strap is connected to the bag at two points, a D-ring near the top of the bag and a ring located near the midpoint of the bag. The one point connection occurs at the D-ring. Connecting the shoulder strap 24 to the actual golf bag 22 at one point gives a lower center of gravity and a more stable ride to the golf bag travel cover 10. This is accomplished because the shoulder strap 24 is not connected to the outer flexible cover 12 which would allow the clubs to freely move within the golf bag travel cover 10 while it is being pulled along in a busy airport thus causing shifts within the golf bag travel cover 10 and/or damage to the golf clubs 20.

The length of the shoulder strap 24 also allows the head of the golf clubs 20 and/or the golf bag travel cover 10 to be situated closer to the ground while being pulled, which will give a more stable ride. The golf bag travel cover 10 will also be easier to steer. The low center of gravity and secure one point attachment of the shoulder strap 24 to the golf bag 22 will assure a more even ride and pull throughout any busy airport and/or other place where the golf bag travel cover 10 is a necessity.

In an alternate embodiment (not shown) for the base member 30 of the golf bag travel cover 10, the locator ring 32 extends outwardly from the bottom face of the base member 30. The locator ring 32 still securely holds the bag within the golf bag travel cover 10, reduces the size of the base and thus the amount of plastic, which in turn reduces the cost of manufacturing such base member 30.

Another alternate embodiment (not shown) for the base member 30 is a hinged hard plastic L-shaped base member directly connected to the flexible cover 12. The wheel 18 is attached to the upright portion of the L-shaped base member. The bottom portion of the L-shaped base member may include the locator ring 32 for securely holding the golf bag 22 once inside the golf bag travel cover 10. This embodiment reduces the cost of manufacturing and the weight of the overall golf bag travel cover 10 and reduces storage space. However, this embodiment still maintains the ability to securely hold the golf bag 22 within the golf bag travel cover 10 and makes it easier to pull the golf bag travel cover 10 up stairs. The member 30 also makes for easy storage because the flexible cover 12 can be folded within itself and then into the L-shaped base member. Next, the L-shaped base member can be folded over at its hinge into a flat structure for very convenient storage. The locator ring 32 in the L-shaped base member is internal to the golf bag travel cover 10. The embodiment also has the capability of standing vertically which makes for easy insertion of the golf bag 22 into the golf bag travel cover 10.

In an alternate embodiment the wheel 18 is completely exposed and is directly preceded by a ramp 34 molded into the base member 30. The ramp 34 may start at the top of the base member 30 where the flexible cover 12 connects and gradually increases to the middle or midpoint portion of the wheel 18. This ramp 34 will allow the golf bag travel cover 10 to engage a step while being pulled, slide along the ramp 34 until a wheel 18 comes into contact with the stair then the wheel 18 will roll the golf bag travel cover 10 onto the next step level. The ramp 34 is only preferred when the wheel 18 is not recessed into the base member 30 as shown in the preferred embodiment.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. In combination, a golf bag travel cover and golf bag comprising:

a golf bag;

a base member having a bottom surface and at least one vertically upwardly extending rigid side;

a flexible cover for substantially enclosing said golf bag connected to said base member:

at least one wheel connected to said base member; and at least one substantially rigid plastic shell at the top of said cover covering the top of said golf bag and the upwardly extending ends of said golf clubs.

2. The golf bag travel cover of claim 1 further including an interior reinforcement band connected to said flexible cover and to said base member.

3. The golf bag travel cover of claim 1 wherein said flexible cover has a greater height than said base member.

4. The golf bag travel cover of claim 1 wherein said base member includes a locator ring secured therein.

5. The golf bag travel cover of claim 1 wherein said base member includes a plurality of wedge shaped guide ribs radially spaced inside said base member.

6. The golf bag travel cover of claim 1 wherein said base member has a hinge between said bottom surface and said side.

7. The golf bag travel cover of claim 1 wherein said base member includes a ramp member located on said vertically extending side and said at least one wheel is connected to said base member below said ramp member.

8. The golf bag travel cover of claim 1 wherein said rigid side is at least 9 inches high.

9. The golf bag travel cover of claim 1 wherein said base member has a plurality of rigid upwardly extending sides.

10. A golf bag travel cover for use in transporting a golf bag containing golf clubs, said golf bag travel cover comprising:

a rigid base member;

a reinforcement band;

a replaceable flexible cover for enclosing said golf bag securely held between said base member and said reinforcement band by removable fasteners; and a plurality of wheels connected to said base member.

11. In combination, a golf bag travel cover and golf bag comprising:

a golf bag;

a base member having a bottom surface and at least one vertically upwardly extending rigid side hingedly connected to said bottom surface;

a flexible cover generally conforming to the upper portion of said golf bag connected to the top of said base member; and at least one wheel connected to said base member.

12. The golf bag travel cover of claim 11 wherein said flexible cover has a greater height than said base member.

13. The golf bag travel cover of claim 11 wherein said base member includes a locator ring.

14. The golf bag travel cover of claim 11 wherein said base member includes a plurality of wedge shaped guide ribs radially spaced inside said base member.

15. The golf bag travel cover of claim 11 wherein said base member includes a ramp member located on said vertically extending side and said at least one wheel is connected to said base member below said ramp member.

16. The golf bag travel cover of claim 11 wherein said rigid side is at least 9 inches high.

17. The golf bag travel cover of claim 11 wherein said base member has a plurality of rigid upwardly extending sides.

18. A golf bag travel cover for use in transporting a golf bag, comprising:

a base member having a bottom surface and at least one vertically upwardly extending rigid side perpendicular thereto and a ramp member located on said vertically extending side, said ramp member having a wedge shape;

a flexible cover connected to said base member:

at least one wheel connected to said base member and extending at least partially past the vertical plane of said rigid side.

19. The golf bag travel cover of claim 18 further including an interior reinforcement band connected to said flexible cover and to said base member.

20. The golf bag travel cover of claim 18 wherein said base member includes a locator ring secured therein.

21. A golf bag travel cover of claim 18 wherein said base member includes a plurality of wedge shaped guide ribs radially spaced inside said base member.

22. The golf bag travel cover of claim 18 wherein said base member has a plurality of rigid upwardly extending ribs.

23. A golf bag travel cover for use in transporting a golf bag containing golf clubs, comprising:

a base member;

a flexible cover for substantially enclosing said golf bag connected to said base member; and a plurality of guide ribs secured within said base member generally arranged extending radially outwardly from a point on said base member, said guide ribs extending upwardly from said base member and having a minimum height at said point and increasing in height toward their radially outermost points.

24. In combination, a golf bag travel cover and golf bag comprising:

a golf bag;

a base member having a bottom surface and at least one vertically upwardly extending rigid side;

a flexible cover connected to said base member, said cover having an orifice;

at least one wheel connected to said base member opposite said orifice; and an elongated strap extending through said orifice connected to said golf bag at a single point.

* * * * *